United States Patent [19]

Hashimoto et al.

[11] Patent Number: 4,833,123

[45] Date of Patent: May 23, 1989

[54] YELLOW DYE-DONOR ELEMENT USED IN THERMAL TRANSFER AND THERMAL TRANSFER AND THERMAL TRANSFER SHEET USING IT

[75] Inventors: Kiyoyasu Hashimoto, Nara; Takashi Omura, Hyogo; Yasuyuki Suzuki; Yoshiaki Hayashi, both of Osaka, all of Japan

[73] Assignee: Sumitomo Chemical Company Limited, Osaka, Japan

[21] Appl. No.: 252,995

[22] Filed: Oct. 4, 1988

[30] Foreign Application Priority Data

Oct. 8, 1987 [JP] Japan ..... 62-255534

[51] Int. Cl.[4] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS 3,920,720 11/1975 Beecken ..... 558/397

4,701,439 10/1987 Weaver et al. ..... 428/480

FOREIGN PATENT DOCUMENTS 0053564 3/1985 Japan ..... 503/227

*Primary Examiner*—Bruce H. Hess

*Attorney, Agent, or Firm*—Cushman, Darby & Cushman

[57] ABSTRACT

A yellow dye-donor element for thermal dye transfer and having good characteristics for ink formation, and a thermal transfer sheet made using the yellow dye-element, having adequate sublimatability or vaporizability, good coloring, with a high printing density on receiving papers, and high storage stability and light stability of printing image, and employable as a yellow color among the three primary colors are provided. The above yellow color-element comprises a yellow dye dispersed or dissolved in a polymeric binder, which is represented by the formula (I):

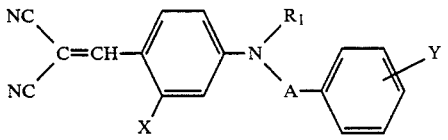

(I)

wherein $R_1$ is an alkyl group of $C_1$–$C_{12}$, an allyl group or a crotyl group; X is hydrogen, halogen or a $C_1$–$C_4$ lower alkyl or $C_1$–$C_4$ lower alkoxy group; Y is a $C_1$–$C_{12}$ alkyl, $C_5$–$C_7$ cycloalkyl, $C_1$–$C_4$ alkoxy, phenyl, tolyl, or phenoxy group; and A is $—CH_2CH_2—$, $—CH_2CH_2O—$, or $—CH_2CH_2CH_2—$.

14 Claims, No Drawings

YELLOW DYE-DONOR ELEMENT USED IN THERMAL TRANSFER AND THERMAL TRANSFER AND THERMAL TRANSFER SHEET USING IT

This invention relates to a yellow dye-donor element, and to a thermal transfer sheet using it.

A method of printing image by thermal transfer, i.e., pictures are formed by causing dyes to sublimate or vaporize by heat, has come into the limelight recently as a method for obtaining color hard copies from televisions, CRT color displays, color facsimiles, magnetic cameras, and others. A thermal source in this method includes heating elements, such as thermal heads, and lasers, especially, semiconductor lasers. Characteristically, it gives a continuous gradation color image, because of the capability to control the amount of sublimating or vaporizing dyes according to the thermal energy given.

For the full color image, dyes of the three primary colors of cyan, magenta, and yellow, are necessary in general, or dyes of four colors additionally containing black color are used, if necessary. As the conditions to be fulfilled by each dye, there may be recited adequate sublimatability or vaporizability, good coloring when thermal energy is given, satisfactory aptitude for inks, and high storage stability of printed image. In this regard, however, no yellow dye which fully fulfills these conditions has yet been found.

For example, U.S. Pat. No. 4,701,439 discloses yellow dye-donor elements used in thermal transfer. The elements have adequate sublimatability and good coloring when thermal energy is given, but do not have adequate storage stability of printed image.

Japanese Unexamined Patent Publication No. 53,564/1985 discloses yellow dye-donor elements which have some apparent similarities to those of the present invention. The elements do not have adequate characteristic for ink formation (for example, isolation of crystals at the time of ink formation or ink sheet preparation), so that the original potential of dye is not fully demonstrated at the printing density of thermal transfer using a thermal head, or they do not have adequate storage of printed image. Thus, the improvement to solve these problems have been expected.

The inventors have earnestly studied to find out a yellow dye-donor element as a color for the three primary colors to be used in thermal transfer with adequate sublimatability or vaporizability, good coloring, good characteristics for ink formation, and high printing density, as well as high storage stability of printing image, and have accomplished the present invention according to the recognition that a specific group of dyes as provided for in the present invention secures the objects as mentioned above.

The present invention is to provide a yellow dye-donor element used in thermal transfer, and a thermal transfer sheet using it, which element comprises a yellow dye dispersed or dissolved in a polymeric binder, the said yellow dye being represented by the following formula (I):

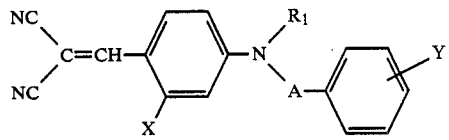

(I)

wherein $R_1$ is an alkyl group of $C_1$–$C_{12}$, an allyl group, or a crotyl group; X is hydrogen, halogen, or a $C_1$–$C_4$ lower alkyl or $C_1$–$C_4$ lower alkoxy group; Y is a $C_1$–$C_{12}$ alkyl, $C_5$–$C_7$ cycloalkyl, $C_1$–$C_4$ alkoxy, phenyl, tolyl, or phenoxy group; and A is $—CH_2CH_2—$, $CH_2CH_2O—$, or $—CH_2CH_2CH_2—$.

In a preferred embodiment of the invention, the $C_1$–$C_{12}$ alkyl group in $R_1$ of the above formula may specifically be methyl, ethyl, propyl, butyl, pentyl, hexyl, heptyl, octyl, 2-ethylhexyl, nonyl, decyl, undecyl, or dodecyl, among which a $C_1$–$C_4$ lower alkyl group is more preferred.

The halogen atom represented by X may be fluorine, chlorine, or bromine. The $C_1$–$C_4$ lower alkyl or $C_1$–$C_4$ lower alkoxy group represented by X may be methyl, ethyl, methoxy, or ethoxy. A more preferred embodiment is the case where X is hydrogen or a methyl group.

The $C_1$–$C_{12}$ alkyl group represented by Y may be methyl, ethyl, propyl, butyl, pentyl, hexyl, heptyl, octyl, 2-ethylhexyl, nonyl, decyl, undecyl, or dodecyl. The $C_5$–$C_7$ cycloalkyl group may be cyclopentyl, cyclohexyl, or cycloheptyl. The $C_1$–$C_4$ alkoxy group represented by Y may be methoxy, ethoxy, propoxy, or butoxy. Further the phenyl, phenoxy, and tolyl groups represented by Y may additionally have a substituent or substituents. More preferred as Y is a $C_5$–$C_7$ cycloalkyl or phenyl group, among others.

Some of the yellow dyes represented by the formula (I) which are employed for the yellow dye-donor elements used in thermal transfer, according to the present invention, are already known in U.S. Pat. No. 3,920,720. Dyes of the formula (I) which are mentioned below are novel: in the formula (I), (1) X, $R_1$ and Y are the same as mentioned above when A is $—CH_2—CH_2—$ or $—CH_2—CH_2—CH_2—$; (2) X, A and Y are the same as mentioned above when $R_1$ is an allyl or crotyl group; and (3) X, $R_1$ and A are the same as mentioned above when Y is an alkoxy, phenyl, tolyl or phenoxy group. The new dyes above are prepared, for example, by formylation of a compound represented by the formula (II):

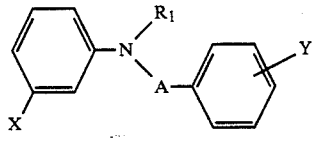

(II)

wherein $R_1$, X, Y and A have the same meanings as above, through the Vilsmeier reaction in a polar solvent such as dimethylformamide, followed by a condensation with malononitrile.

To make the thermal transfer sheets of the present invention, a yellow dye represented by the formula (I) is treated to form an ink, which is then applied onto one side surface of a supporting material and dried to form a dye-carrying layer.

The yellow dyes used herein and set forth in the formula (I) may be used singly or as a blend of two or more of them.

As the supporting material, condenser papers, cellophane, polyimide resins, polyester resins, poly (ethersulfone) resins, and others, are illustrated.

As a preferred embodiment, a supporting material in the form of ribbon or film, with a yellow dye-carrying layer formed at one side surface, and with the other side surface treated for an increased heat resistance and/or an increased slipping, is illustrated.

To make an ink of the yellow dyes, components consisting of a yellow dye of the formula (I), a polymeric binder, a solvent, and a compound which absorbs laser-oscillated wave lengths in case of using a laser as the thermal source, if necessary, along with any known additive or additives, are treated to make solution or dispersion using a ball mill or a paint conditioner.

As the polymeric binder, there may be illustrated natural resins such as gum dammar, gum arabic, tragacanth, dextrin and casein, and their modified resins; cellulose resins such as methylcellulose, ethylcellulose, hydroxyethylcellulose, ethylhydroxycellulose and nitrocellulose; acrylic resins; vinyl resins such as polyvinyl alcohol and polyvinyl acetate, and the like. These may be employed singly or as a mixture of two or more of them.

As the solvent used herein, there may be illustrated water; alcohols such as ethanol, propanol and butanol; ketones such as acetone, methyl ethyl ketone, and methyl isobutyl ketone; aromatic hydrocarbons such as toluene, xylene and monochlorobenzene; chlorinated solvents, such as dichloroethane, trichloroethylene and perchloroethylene; acetate esters such as ethyl acetate, butyl acetate and ethoxyethyl acetate; and the like. These may be employed singly or as a mixture of two or more of them.

As the compound which absorbs laser-oscillated wave lengths, there may be illustrated carbon black, phthalocyanine colors, dithiol complexes, naphthoquinones and others.

To prepare the thermal transfer sheets of the present invention, a dye ink thus-obtained is applied onto a supporting material as mentioned above, using a bar coater, a roll coater, or a knife coater, or according to the screen printing or gravure printing technique.

The method for printing using the thus-prepared thermal transfer sheets may be of any known way, thus resulting in distinct image on printing papers.

As the receiving papers, papers coated with a polyester resin or a polyamide resin, synthetic papers made of polypropylene, polyvinyl chloride, polyester, or others, and those synthetic papers treated to increase the heat resistance, and coated, if required, with a polyester or polyamide resin having affinity to dyes, are employable.

Thus, an object of the present invention is to provide a yellow dye-donor element used in thermal transfer, comprising a yellow dye represented by the formula (I), which has good characteristics for ink formation. Another object of the invention is to provide a thermal transfer sheet made using an ink prepared from the dyes, having adequate sublimatability or vaporizability, good coloring, for example, with high printing density on receiving papers, and high storage stability and light stability of printing image, and employable as a yellow color among the three primary colors.

The other objects will be obvious from the description.

The following examples are provided to more specifically illustrate the invention. In the examples, parts are by weight.

EXAMPLE 1

(i) Preparation of the dye

In 700 parts of dimethylformamide was dissolved 323 parts of N-ethyl-N-[2-(4-cyclohexylphenoxy) ethyl]aniline. The solution was cooled to a temperature of 0° to 10° C., and 230 parts of phosphorus oxychloride was added thereto.

Then, 120 parts of pyridine was added thereto at that temperature. The solution was heated up to 40° C., and kept at the temperature level for 1 hour. After cooling down to 20° C., 400 parts of methanol and 346 parts of sodium acetate were added sequentially to the solution at a temperature of 20° to 30° C.

The solution was mixed with a solution of 66 parts of malononitrile in 20 parts of methanol at a temperature of 40° to 50° C., then heated up to 70° C. and kept at the temperature level for 1 hour. Then, the mixture was cooled down to the ambient temperature, and poured into 4000 parts of water. The isolated crystals were separated by filtration, washed with water, and dried, to obtain a dye of the following formula (1).

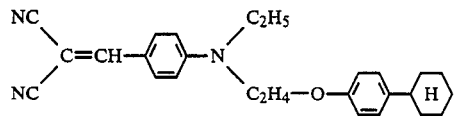

(1)

λmax(DMF) 436 nm
m.p. 109–110° C.

(ii) Method of ink formation

| | |
|---|---|
| The dye obtained in the above (i) | 2 parts |
| ethylcellulose | 6 parts |
| toluene | 44 parts |
| methyl ethyl ketone | 44 parts |
| in total | 96 parts |

An ink was formed by fully dispersing the mixture of the above components with glass beads by means of a paint conditioner.

(iii) Method of preparing thermal transfer sheet

A thermal transfer sheet was prepared by applying the ink onto a polyester film of 6 μm thickness, which had been treated to increase the heat resistance in advance, using a bar coater to form a 12 μm thickness wet layer, and drying the layer using a hot wind dryer at 80° C. This sheet showed no crystallization of the dye, thus proving excellency of the characteristics of the dye for ink formation.

(iv) Method of preparing image-receiving paper

A dye image-receiving paper was prepared by applying a 20% by weight saturated polyester resin (Vyron 200; made by TOYOBO Co. Ltd.) solution in toluene-methyl ethyl ketone onto a synthetic paper (Yupo FPG #150; Ōji-Yuka Synthetic Paper Co. Ltd.) using a bar coater to form a 12 μm thick wet layer, and drying the layer using a hot wind dryer at 80° C. for 30 minutes.

(v) Method of transfer-printing

The ink-applied surface of the above thermal transfer sheet was placed face-to-face with the paint-applied surface of the above image-receiving paper, and thermal transfer printing was conducted using a heat-sensitive head (8 volts, 21 milliseconds) having 200 ohm heating resistors in 4 dots/mm density, to give yellow color records of a 1.31 printing density. The printing density was measured using a densitometer, RD-914, manufactured by Macbeth in the United States. Light stability of the resulting color records was tested using a carbon arc fade-o-meter (manufactured by Simadzu Seisakusho Limited). After 40 hour irradiation, almost no decoloration was observed. Storage stability of printing image at a higher temperature (60° C.) and a higher humidity (80%) was also proved to be excellent.

EXAMPLE 2

In 700 parts of dimethylformamide was dissolved 337 parts of N-ethyl-N-[2-(4-cyclohexylphenoxy) ethyl]-3-methylaniline. The solution was cooled to a temperature of 0° to 10° C., and 230 parts of phosphorous oxychloride was added thereto.

Then, 130 parts of pyridine was added thereto at that temperature. The solution was heated up to 40° C., and kept at the temperature level for 1 hour. After cooling down to 30° C., 400 parts of methanol and 346 parts of sodium acetate were added sequentially to the solution at a temperature of 20° to 30° C.

The solution was mixed with a solution of 66 parts of malononitrile in 20 parts of methanol at a temperature of 40° to 50° C., then heated to 70° C. and kept at the temperature level for 1 hour. Then, the mixture was cooled down to the ambient temperature, and poured into 4000 parts of water. The isolated crystals were separated by filtration, washed with water, and dried, to yield a dye of the following formula (2).

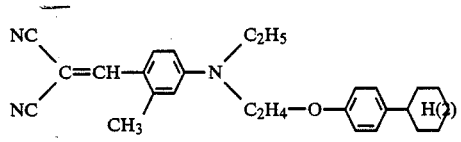

λmax(DMF) 446 nm
m.p. 117–118° C.

Using the dye of the formula (2), the ink formation, the preparation of a thermal transfer sheet, the preparation of an image-receiving paper, and the transfer printing, were conducted in similar ways as in Example 1, excepting that hydroxyethylcellulose was employed instead of the ethylcellulose used in Example 1, (ii). The resulting yellow printing image had a 1.35 printing density, with satisfactory light stability and excellent storage stability at higher temperatures and higher humidities.

EXAMPLE 3

In 600 parts of dimethylformamide was dissolved 317 parts of N-ethyl-N-[2-(2-phenylphenoxy) ethyl]aniline. The solution was cooled to a temperature of 0° to 10° C., and 230 parts of phosphorous oxychloride was added thereto.

Then, 130 parts of pyridine was added thereto at that temperature. The solution was heated up to 40° C., and kept at the temperature level for 1 hour. After cooling down to 30° C., 400 parts of ethanol and 346 parts of sodium acetate were added sequentially to the solution at a temperature of 20° to 30° C.

The solution was mixed with a solution of 66 parts of malononitrile in 20 parts of ethanol at a temperature of 40° to 50° C., then heated up to 70° C. and kept at the temperature level for 1 hour. Then the mixture was cooled down to the ambient temperature, and poured into 4000 parts of water. The isolated crystals were separated by filtration, washed with water, and dried, to obtain a dye of the following formula (3).

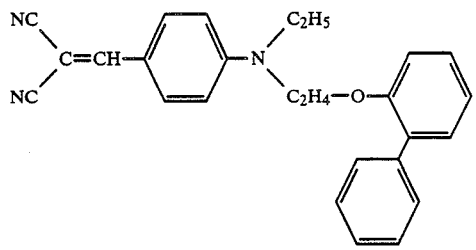

(3)

λmax(DMF) 438 nm
m.p. 124–125° C.

Using the dye of the formula (3), the ink formation, the preparation of a thermal transfer sheet, the preparation of an image-receiving paper, and the transfer printing were conducted in similar ways as in Example 1, excepting that 88 parts of isopropyl alcohol was employed instead of 44 parts of toluene and 44 parts of methyl ethyl ketone used in Example 1, (ii). The resulting yellow printing image had a 1.30 printing density, with satisfactory light stability and excellent storage stability at higher temperatures and higher humidities.

EXAMPLES 4 TO 7

In similar ways as in Example 1, dyes of the formulas (4) through (7) set forth in the following Table-1 were obtained. Thermal transfer sheets were prepared using the respective dyes. Each thermal transfer test obtained distinct yellow pictures with high density and good stabilities against light and humidity, as well as excellent storage stability.

TABLE 1

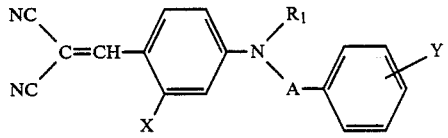

| Dyes No. | X | Y | A | $R_1$ | (DMF) λmax (n · m) |
|---|---|---|---|---|---|
| (4) | H | 4- 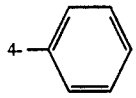 | $-C_2H_4O-$ | $-C_2H_5$ | 439 |
| (5) | H | 4-$CH_3$ | $-C_2H_4O-$ | $-C_2H_5$ | 436 |
| (6) | H | 4-$C_2H_5$ | $-C_2H_4O-$ | $-C_2H_5$ | 436 |
| (7) | H | 4-$C_4H_9$ | $-C_2H_4O-$ | $-C_2H_5$ | 437 |

EXAMPLE 8

In 700 parts of dimethylformamide was dissolved 271 parts of N-ethyl-N-[2-(4-methoxyphenoxy)ethyl]aniline. The solution was cooled to a temperature of 0° to 10° C., and 230 parts of phosphorous oxychloride was added thereto.

Then, 130 parts of pyridine was added thereto at that temperature. The solution was heated up to 40° C., and kept at the temperature level for 1 hour. After cooling down to 30° C., 400 parts of methanol and 346 parts of sodium acetate were added sequentially to the solution at a temperature of 20° to 30° C.

The solution was mixed with a solution of 66 parts of malononitrile in 20 parts of methanol at a temperature of 40° to 50° C., then heated to 70° C. and kept at the temperature level for 1 hour. Then, the mixture was cooled down to the ambient temperature, and poured into 4000 parts of water. The isolated crystals were separated by filtration, washed with water, and dried, to yield a dye of the following formula (8).

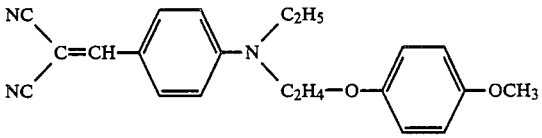

(8)

λmax(DMF) 439 nm
m.p. 119–120° C.

Using the dye of the formula (8), the preparation of a thermal transfer sheet and the transfer printing were conducted in similar ways as in Example 1. The resulting yellow printing image had a 1.20 printing density, with satisfactory light stability and excellent storage stability at higher temperatures and higher humidities.

EXAMPLE 9

In 700 parts of dimethylformamide was dissolved 330 parts of N-ethyl-N-[2-(4-phenoxyphenoxy)ethyl]aniline. The solution was cooled to a temperature of 0° to 10° C., and 230 parts of phosphorous oxychloride was added thereto.

Then, 130 parts of pyridine was added thereto at that temperature. The solution wa heated up to 40° C., and kept at the temperature level for 1 hour. After cooling down to 30° C., 400 parts of methanol and 346 parts of sodium acetate were added sequentially to the solution at a temperature of 20° to 30° C.

The solution was mixed with a solution of 66 parts of malononitrile in 20 parts of methanol at a temperature of 40° to 50° C., then heated up to 70° C. and kept at the temperature level for 1 hour. Then the mixture was cooled down to the ambient temperature, and poured into 4000 parts of water. The isolated crystals were separated by filtration, washed with water, and dried, to obtain a dye of the following formula (9).

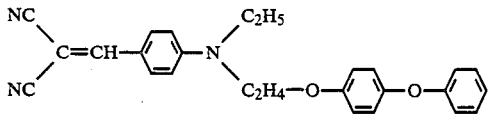

(9)

λmax(DMF) 437 nm
m.p. 129–130° C.

Using the dye of the formula (9), the preparation of a thermal transfer sheet and the transfer printing were conducted in similar ways as in Example 1. The resulting yellow printing image had a 1.24 printing density, with satisfactory light stability and excellent storage stability at higher temperatures and higher humidities.

EXAMPLE 10

In 700 parts of dimethylformamide was dissolved 253 parts of N-ethyl-N-[2-(4-methylphenyl)ethyl]-3-methylaniline. The solution was cooled to a temperature of 0° to 10° C., and 230 parts of phosphorous oxychloride was added thereto.

Then, 130 parts of pyridine was added thereto at that temperature. The solution was heated up to 40° C., and kept at the temperature level for 1 hour. After cooling down to 30° C., 400 parts of methanol and 346 parts of sodium acetate were added sequentially to the solution at a temperature of 20° C. to 30° C.

The solution was mixed with a solution of 66 parts of malononitrile in 20 parts of methanol at a temperature of 40° to 50° C., then heated up to 70° C. and kept at the temperature level for 1 hour. Then the mixture was cooled down to the ambient temperature, and poured into 4000 parts of water. The isolated crystals were separated by filtration, washed with water, and dried to obtain a dye of the following formula (10).

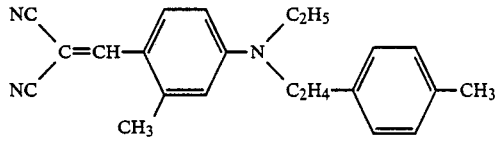

(10)

λmax(DMF) 441 nm
m.p. 120 -121° C.

Using the dye of the formula (10), the preparation of a thermal transfer sheet and the transfer printing were conducted in similar ways as in Example 1. The resulting yellow printing image had a 1.25 printing density, with satisfactory light stability and excellent storage stability at higher temperatures and higher humidities.

EXAMPLES 11 TO 14

In similar ways as in Example 1, dyes of the formulas (11) through (14) set forth in the following Table-2 were obtained. Thermal transfer sheets were prepared using the respective dyes. Each thermal transfer test obtained distinct yellow pictures with high density and good stabilities against light and humidity, as well as excellent storage stability.

TABLE 2

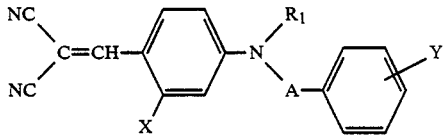

| Dyes No. | X | Y | A | $R_1$ | (DMF) λmax (n · m) |
|---|---|---|---|---|---|
| (11) | $CH_3$ | 4-H | $-C_2H_4-$ | $-C_2H_5$ | 445 |
| (12) | $CH_3$ | 4-$CH_3$ | $-C_2H_4O-$ | $-C_2H_5$ | 438 |
| (13) | $CH_3$ | 4-H | $-C_2H_4O-$ | $-C_9H_{19}$ | 448 |
| (14) | H | 4-$CH_3$ | $-C_2H_4-$ | $-C_2H_5$ | 438 |

EXAMPLE 15

In 700 parts of dimethylformamide was dissolved 436 parts of N-crotyl-N-[2-[4-(4-methylphenyl)phenoxy]ethyl]-3-bromoaniline. The solution was cooled to a temperature of 0° to 10° C., and 230 parts of phosphorous oxychloride was added thereto.

Then, 130 parts of pyridine was added thereto at that temperature. The solution was heated up to 40° C., and kept at the temperature level for 1 hour. After cooling down to 30° C., 400 parts of methanol and 346 parts of sodium acetate were added sequentially to the solution at a temperature of 20° to 30° C.

The solution was mixed with a solution of 66 parts of malononitrile in 20 parts of methanol at a temperature of 40° to 50° C., then heated to 70° C. and kept at the temperature level for 1 hour. Then, the mixture was cooled down to the ambient temperature, and poured into 4000 parts of water. The isolated crystals were separated by filtration, washed with water, and dried, to yield a dye of the following formula (15).

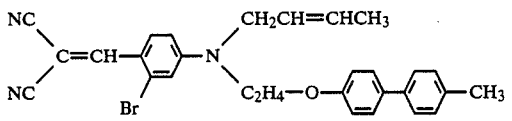

(15)

λmax(DMF) 439 nm
m.p. 134–135° C.

Using the dye of the formula (15), the preparation of a thermal transfer sheet and the transfer printing were conducted in similar ways as in Example 1. The resulting yellow printing image had a 1.20 printing density, with satisfactory light stability and excellent storage stability at higher temperatures and higher humidities.

The experimental results from Examples 1 through 15 are tabulated in Table-3.

In Table-3, evaluations on ink-forming characteristic, light resistance, and storage stability are shown according to the following standards:

Ink-forming characteristic;

mark Δ shows isolated crystals of a dye observed at the time of ink formation or preparation of a thermal transfer sheet, and mark ○ shows no isolated crystal observed.

Light stability;

mark Δ shows decoloration observed after 40 hour fade-o-meter irradiation, and mark ○ shows no decoloration observed.

Storage stability;

printing image is put on white paper and they are left to stand in a thermostat at 60° C. and under 80% humidity for three days.

Indices of dirty of the white paper are:

◎ No. 5 of Gray scale (JIS L 0805)

○ No. 4–5 of Gray scale (JIS L 0805)

Δ No. 3–4 of Gray scale (JIS L 0805)

TABLE 3

| | ink-forming characteristic | printing density | light stability | storage stability |
|---|---|---|---|---|
| Example No. | | | | |
| 1 dye (1) | ○ | 1.31 | ○ | ◎ |
| 2 dye (2) | ○ | 1.35 | ○ | ◎ |
| 3 dye (3) | ○ | 1.30 | ○ | ○ - ◎ |
| 4 dye (4) | ○ | 1.29 | ○ | ○ - ◎ |
| 5 dye (5) | ○ | 1.22 | ○ | ○ |

TABLE 3-continued

| | ink-forming characteristic | printing density | light stability | storage stability |
|---|---|---|---|---|
| 6 dye (6) | ○ | 1.24 | ○ | ○ |
| 7 dye (7) | ○ | 1.27 | ○ | ○ - ◎ |
| 8 dye (8) | ○ | 1.20 | ○ | ○ |
| 9 dye (9) | ○ | 1.24 | ○ | ○ - ◎ |
| 10 dye (10) | ○ | 1.25 | ○ | ○ |
| 11 dye (11) | ○ | 1.35 | ○ | ○ - ◎ |
| 12 dye (12) | ○ | 1.25 | ○ | ○ |
| 13 dye (13) | ○ | 1.20 | ○ | ○ |
| 14 dye (14) | ○ | 1.21 | ○ | ○ |
| 15 dye (15) | ○ | 1.20 | ○ | ○ |

COMPARATIVE EXAMPLES 1–5

Dyes of the following formulas A to E were employed with otherwise the similar procedures as in Example 1. The results are shown in Table-4.

TABLE 4

| Comparative Examples | dyes | ink-forming characteristic | printing density | light stability | storage stability |
|---|---|---|---|---|---|
| 1 | A | Δ | 0.97 | ○ | Δ |
| 2 | B | Δ | 0.95 | ○ | Δ |
| 3 | C | Δ | 1.18 | ○ | Δ |
| 4 | D | Δ | 1.20 | ○ | Δ |
| 5 | E | Δ | 1.19 | ○ | Δ |

Dyes A and B employed in Comparative Examples have been described in the specification of Japanese Unexamined Patent Publication No. 53,564/1985, and have the following structures, respectively.

A

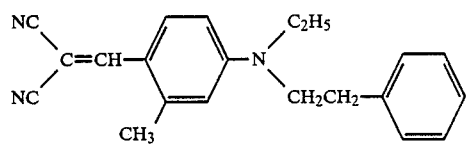

B

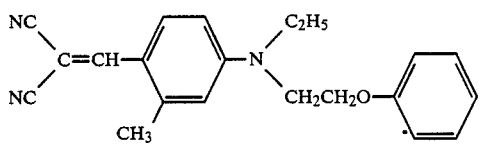

Dyes C and D employed in Comparative Examples have been described in the specification of Japanese Unexamined Patent Publication No. 162,396/1986, and dye E described in the specification of U.S. Pat. No. 4,701,439. They have the following structures, respectively.

C

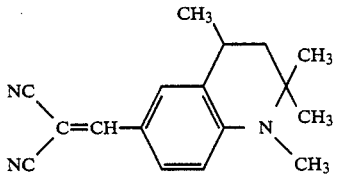

-continued

D

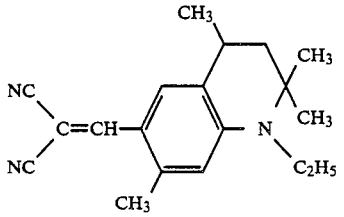

E

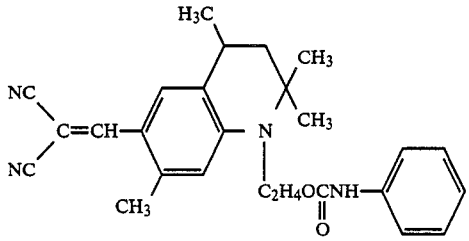

What is claimed is:

1. A yellow color-donor element used in thermal transfer, which comprises a yellow dye dispersed or dissolved in a polymeric binder, the said yellow dye being represented by the following formula (I):

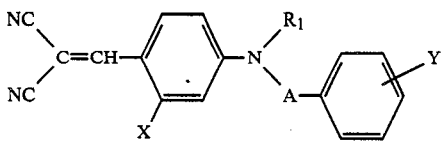

(I)

wherein $R_1$ is an alkyl group of $C_1$–$C_{12}$, an allyl group or a crotyl group; X is hydrogen, halogen, or a $C_1$–$C_4$ lower alkyl or $C_1$–$C_4$ lower alkoxy group; Y is a $C_1$–$C_{12}$ alkyl, $C_5$–$C_7$ cycloalkyl, $C_1$–$C_4$ alkoxy, phenyl, tolyl, or phenoxy group; and A is $—CH_2CH_2—$, $—CH_2CH_2O—$, or $—CH_2CH_2CH_2—$.

2. The yellow color-donor element according to claim 1 wherein X in the formula (I) is hydrogen or a methyl group.

3. The yellow colo-donor element according to claim 1 wherein Y in the formula (I) is a phenyl or $C_5$–$C_7$ cycloalkyl group.

4. The yellow color-donor element according to claim 1 wherein A in the formula (I) is $—CH_2CH_2O—$ or $—CH_2CH_2—$.

5. The yellow color-donor element according to claim 1 wherein the yellow dye is that represented by the formula:

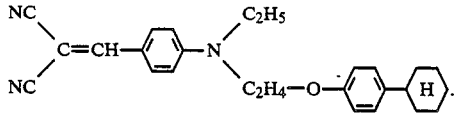

6. The yellow color-donor element according to claim 1 wherein the yellow dye is that represented by the formula:

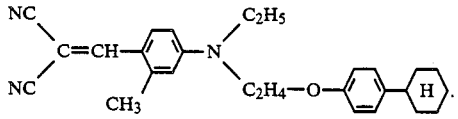

7. The yellow color-donor element according to claim 1 wherein the yellow dye is that represented by the formula:

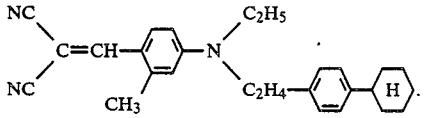

8. A thermal transfer sheet which comprises a supporting material and a yellow dye-donor element layer comprising a yellow dye dispersed or dissolved in a polymeric binder, said layer being applied onto one side surface of the supporting material and the said yellow dye being represented by the formula (I):

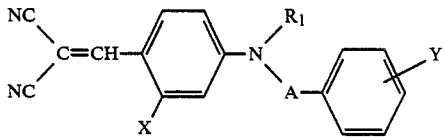

(I)

wherein $R_1$ is an alkyl group of $C_1$–$C_{12}$, an allyl group or a crotyl group; X is hydrogen, halogen, or a $C_1$–$C_4$ lower alkyl or $C_1$–$C_4$ lower alkoxy group; Y is a $C_1$–$C_{12}$ alkyl, $C_5$–$C_7$ cycloalkyl, $C_1$–$C_4$ alkoxy, phenyl, tolyl, or phenoxy group; and A is $—CH_2CH_2—$, $—CH_2CH_2O—$, or $—CH_2CH_2CH_2—$.

9. The thermal transfer sheet according to claim 8 wherein X in the formula (I) is hydrogen or a methyl group.

10. The thermal transfer sheet according to claim 8 wherein Y in the formula (I) is a phenyl or $C_5$–$C_7$ cycloalkyl group.

11. The thermal transfer sheet according to claim 8 wherein A in the formula (I) is $—CH_2CH_2O—$ or $—CH_2CH_2—$.

12. The thermal transfer sheet according to claim 8 wherein the yellow dye is that represented by the formula:

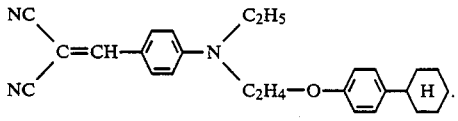

13. The thermal transfer sheet according to claim 8 wherein the yellow dye is that represented by the formula:

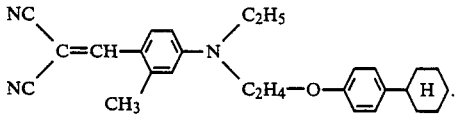

14. The thermal transfer sheet according to claim 8 wherein the yellow dye is that represented by the formula:

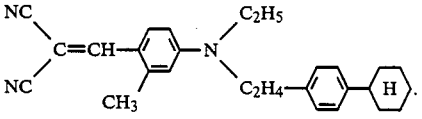

* * * * *